United States Patent [19]

Trubiano

[11] Patent Number: 4,592,286

[45] Date of Patent: Jun. 3, 1986

[54] SHELF CORNER SUPPORT STRUCTURE

[75] Inventor: Antoine Trubiano, Pointe aux Trembles, Canada

[73] Assignee: Cari-All Inc., Quebec, Canada

[21] Appl. No.: 561,530

[22] Filed: Dec. 15, 1983

[51] Int. Cl.[4] ..... A47B 9/00; A47B 47/00; A47G 29/02

[52] U.S. Cl. ..... 108/108; 108/152; 211/187; 211/208; 248/243

[58] Field of Search ..... 108/111, 152, 154, 156, 108/159, 114, 108; 248/243; 403/191, 233, 235, 398; 211/175, 207, 208, 186, 187, 182, 191

[56] References Cited

U.S. PATENT DOCUMENTS 4,230,052 10/1980 Champagne ..... 248/243
4,421,239 12/1983 Vargo ..... 211/187

FOREIGN PATENT DOCUMENTS 913733 12/1962 United Kingdom ..... 108/152

*Primary Examiner*—William E. Lyddane
*Assistant Examiner*—Gerald A. Anderson
*Attorney, Agent, or Firm*—Oblon, Fisher, Spivak, McClelland & Maier

[57] ABSTRACT

A shelf support structure for supporting a shelf on support posts having an adjustably positionable support bracket. The bracket has a pair of spaced apart upwardly extending protruding side arms defining respective notches between its associated post and the arms. The invention resides in that the support structure comprises a flat rigid plate member connected to a shelf vertical side wall. The plate member has a pair of vertically extending slotted bores. The pair of side arms of the bracket are receivable in the pair of vertical slotted bores whereby to receive the plate member seated across the notches forwardly of the post associated therewith.

9 Claims, 7 Drawing Figures

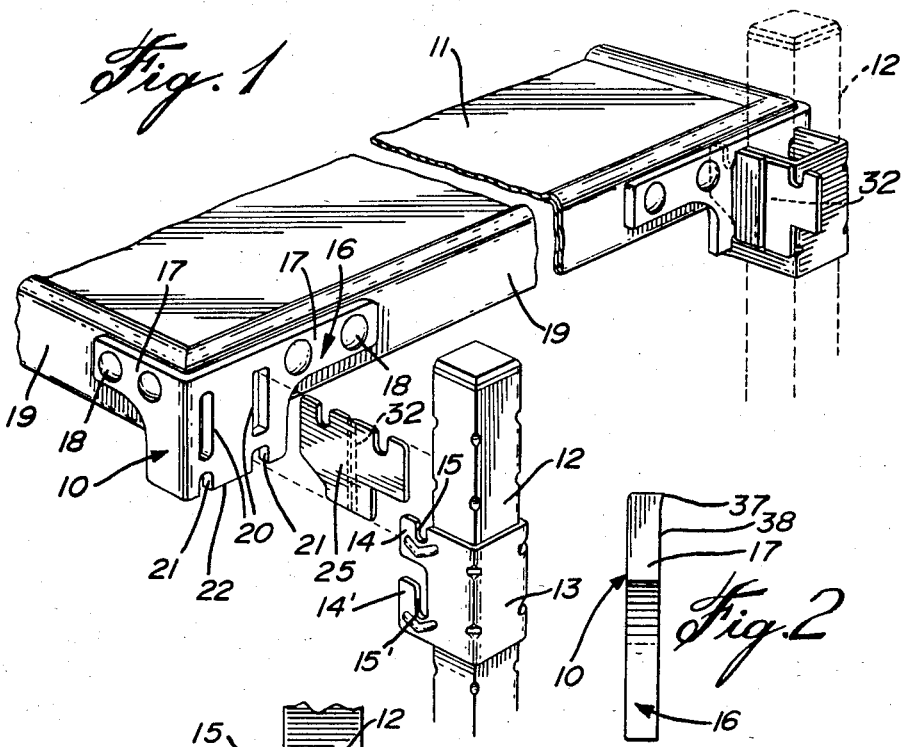
Fig. 1
Fig. 2
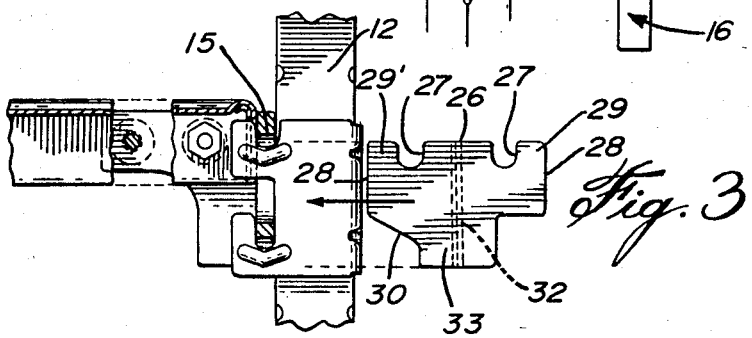
Fig. 3
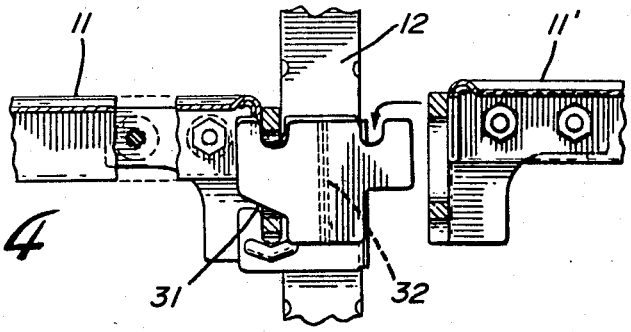
Fig. 4

SHELF CORNER SUPPORT STRUCTURE

BACKGROUND OF INVENTION (a) Field of the Invention

The present invention relates to an improved shelf support structure for supporting a shelf between support posts of the type having an adjustably positionable support bracket equipped with a pair of spaced apart upwardly extending protruding side arms and wherein the support structure comprises a flat rigid plate having slots therein to receive the side arms whereby the plate member is held against the post.

(b) Description of Prior Art

Various types of shelf support structures have been provided such as that described in U.S. Pat. No. 4,230,052 issued on Oct. 28, 1980 and for use in a shelving system having post support brackets and as shown in U.S. Pat. No. 4,079,678 issued on Mar. 21, 1978. Such corner shelf support structures are costly to produce in view of their designs, time extensive to assemble and do not provide for support of adjacent shelving in planar alignment to a shelf supported between four of these posts provided with such support brackets.

SUMMARY OF INVENTION

It is a feature of the present invention to provide an improved shelf support structure which substantially overcomes the above-mentioned disadvantages of the prior art.

Another feature of the present invention is to provide an improved shelf support structure which is easy to construct, easy to assemble, more economical than that of the prior art and which requires very little forming to the corner of a shelf for attachment thereto.

Another feature of the present invention is to provide an improved shelf support structure having a shelf support bridge plate for supporting a shelf in planar alignment to a shelf supported between four support posts.

According to the above features, from a broad aspect, the present invention provides a shelf support structure for supporting a shelf on support posts having an adjustably positionable support bracket. The bracket has a pair of spaced apart upwardly extending protruding side arms defining respective notches between its associated post and the arms. The support structure comprises a flat rigid plate member having securing means to connect same to a shelf vertical side wall. The plate member has a pair of vertically extending slotted bores. The pair of side arms of the bracket are receivable in the pair of vertical slotted bores for receiving the plate member seated across the notches forwardly of the post associated therewith.

BRIEF DESCRIPTION OF DRAWINGS

A preferred embodiment of the present invention will not be described with reference to the example thereof as illustrated in the accompanying drawings in which:

FIG. 1 is a fragmented perspective view showing the shelf support structure of the present invention;

FIG. 2 is a section view through the plate member of the shelf support structure;

FIG. 3 is a fragmented view, partly sectioned, showing the shelf support structure engaged by a post support bracket and further showing the configuration of the shelf support bridge plate;

FIG. 4 is a fragmented side view, partly sectioned, showing the engagement of the bridge plate to support a further shelf in planar alignment with a shelf supported between four posts;

DESCRIPTION OF PREFERRED EMBODIMENTS

Figure 5:
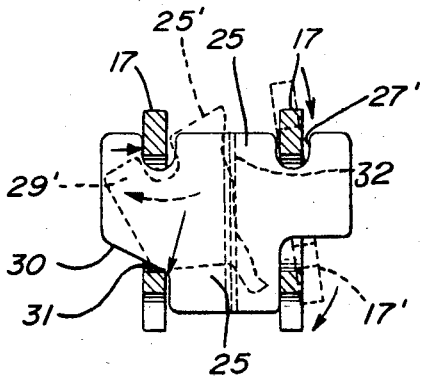
FIG. 5 is a side view showing the operation of the shelf support bridge plate.

Referring now to the drawings and more particularly to FIG. 1, there is shown the shelf support structure 10 secured to a shelf 11 whereby the shelf may be supported by support posts 12 which are provided with adjustable positioning support brackets 13. The bracket 13 has a pair of spaced apart upwardly extending protruding side arms 14 defining respective notches 15 between its associated post 12 and the arms 14. The construction and operation of the post 12 and support bracket 13 does not form part of this invention and is disclosed in the aforementioned U.S. Pat. No. 4,079,678.

The support structure 10 comprises a flat rigid plate member, herein a right angle plate member 16, having two connecting arms 17 with each arm having at least one hole therein for receiving a fastener 18 whereby to secure the plate member to opposed depending side walls 19 at a corner of the shelf 11.

The plate member 16 is provided with a pair of vertically extending slotted bores 20 in an enlarged portion of one of the side arms 17 and in a corner area thereof whereby the post 12 is positioned at such corner area. The slotted bores 20 are configured whereby to receive the pair of side arms 14 of the bracket 13. As shown in FIG. 1, the bracket has a second pair 14' of such side arms and a pair of open-ended notches 21 is provided in the bottom edge 22 below the slotted bores 20 and disposed in alignment therewith whereby to engage with the lower pair of side arms 14'. Thus, the enlarged portion of the plate member 17 is received seated across the notches 15 and 15' of the support bracket and forwardly of the post 12 to provide a rigid secured connection.

Figure 6:
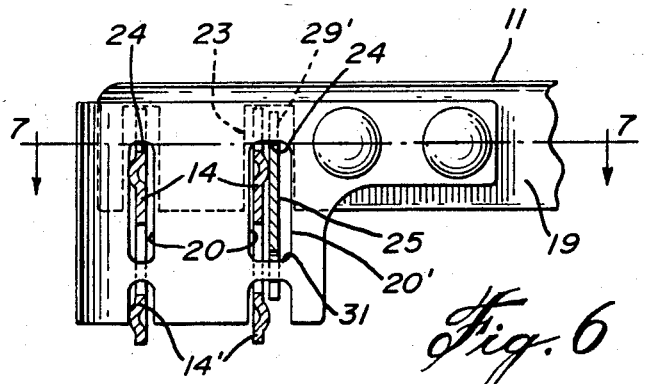
FIG. 6 is a fragmented end view of a shelf corner showing the shelf support structure secured thereto.

As seen in FIG. 6, one of the side walls 19 of the shelf 11 is provided with a cut out portion, identified by phantom lines 23 and juxtaligned with the slotted bores 20 and also extends above a top end 24 of the slotted bores 20 to provide passage of the bracket side arms 14 and 14' when received in the slotted bores 20. It can also be seen from this figure that the inner slotted bore 20– is wider than the other bore whereby to receive therein a shelf support bridge plate 25 and positioned in side-by-side relationship with the arm 14 located therein.

The purpose of the bridge plate 25 is to support an additional shelf 11' in planar alignment between two pairs of posts 12 secured to respective shelves 11 and spaced apart a distance wherein to receive a shelf 11' therebetween. In use, there may be several rows of shelves secured in planar alignment or in side-by-side relationship. This bridge plate 25 provides for the support of intermediate shelves, such as 11', and also permits intermediate shelves 11' to be removed from the assembly without dismantling any of the adjacent shelf support posts, as will be described later.

The bridge plate 25 is a flat rigid metal plate having a top edge 26 with a support notch 27 formed adjacent the opposite vertical edges 28 thereof whereby to define opposed support end fingers 29 for engaging in the slotted bores 20 of an associated connecting arm 17 of a respective shelf support plate member 10. One of the fingers, namely 29', is provided with a lower support edge 30 for abutment with a lower end 31 of the wider slotted bore 20'. This lower support edge 30 is a straight angulated edge extending inwardly downwards under the support end finger 29' to permit the finger to enter within the wider slotted bore and to maintain a top free end portion of the finger 29' behind a top wall portion of the wider slotted bore 20', as clearly shown in FIG. 6.

Referring to FIG. 5, there is shown the manner in which the bridge plate 25 is engaged with respective support plate members 17 of adjacent shelves 11 and 11'. As shown in phantom line 25', the bridge plate is angulated and its support end finger 29' is inserted in the enlarged slotted bore 20' to assume a position as shown in solid line and wherein the lower support edge 30 rests against the lower end 31 of the slotted bore 20'. Phantom line 17' also illustrates the manner in which the other support plate member 17 of the shelf 11' is positioned in the support notch 27'. The slotted bore 20' is wide enough to accommodate both one of the side arms 14 of the support bracket 13 and the bridge plate 25 in juxtaposed side-by-side relationship.

Figure 7:
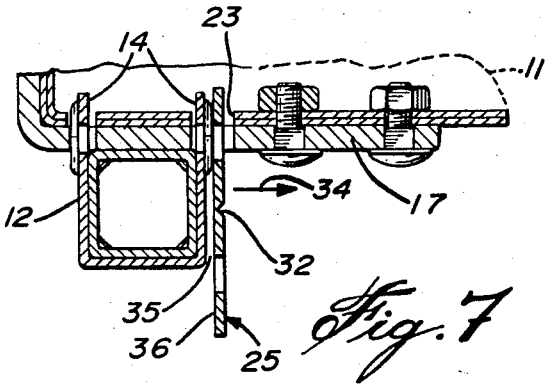
FIG. 7 is a cross-section view along cross-section lines VII–VII of FIG. 6.

As shown in FIGS. 3, 4 and 7, the bridge plate 25 is also provided with a straight vertical slot 32 in an outer surface 33 thereof to define a line of weakness to break or sever the plate in two sections by the application of a transverse wedging force in the direction of arrow 34, as shown in FIG. 7, whereby an intermediate shelf, such as 11', may be removed from an assembly without dismantling the support post 12 of supporting adjacent shelf sections. This wedging force can be applied by inserting a screwdriver end (not shown) in the gap 35 intermediate the support post 12 and the opposed outer surface 36 of the bridge plate 25.

As shown in the embodiment of the shelf structure in FIG. 1, the shelf has a rectangular support surface 11' and right angle depending side walls 19 integrally formed therewith. In order to provide a good flush connection between the right angle plate member 16 and the depending side walls 19 of a shelf corner, the connecting arms 17 of the plate member 10 are provided with a pointed lip 37 extending along a top edge of an inner face 38 thereof whereby to grip into the respective side walls 19 of the shelf corner. This eliminates the formation of a gap or slot wherein foodstuff could accumulate. Also, the fact that the corner of the shelf 11 is simply constructed by bending side wall portions 19 at a 90° angle, there is but a single joint formed in the corner, further eliminating areas where foodstuff could lodge itself and making the structure easily cleanable and very sanitary. This feature, of course, is applicable to the use of the shelf for supporting foodstuff and it is not intended to limit the application of the invention to such use as this type of support structure could be used on any application.

It is within the ambit of the present invention to provide any obvious modifications of the example of a preferred embodiment described herein, provided such modifications fall within the scope of the appended claims.

I claim:

1. A shelf support structure for supporting a rectangular shelf having right-angle corners with right-angle depending vertical side walls, support posts having an adjustably positionable support bracket for supporting said shelf, said bracket having a pair of spaced apart upwardly extending protruding side arms defining respective notches between its associated post and said side arms, said support structure comprising a flat rigid right-angle plate member having two connecting arms disposed at right angles to one another, each said connecting arms having securing means for connection to a respective one of said vertical side walls of each said right-angle corners of said shelf to connect same to a shelf vertical side wall, one of said connecting arms having a pair of vertically extending slotted bores, said pair of side arms of said bracket being receivable in said pair of vertical slotted bores for receiving said plate member seated across said notches forwardly of said post associated therewith and a flat bridge plate for supporting opposed rectangular shelves in planar relationship, said bridge plate having a top edge with a support notch formed adjacent the ends thereof to define opposed support end fingers, said fingers being received in a respective one of said slotted bores of opposed plate members of said opposed shelves, one of said fingers having a lower support edge for abutment with a lower end of an associated slotted bore.

2. A shelf support structure as claimed in claim 1 wherein there is provided a pair of open-ended notches in a bottom edge of said connecting arm having said slotted bores, said notches being aligned with a respective one of said slotted bores.

3. A shelf support structure as claimed in claim 2 wherein said side wall of said shelf, to which said connecting arm having said slotted bores is connected to, is provided with a cut-out portion juxtaligned with said slotted bores and extending above a top end of said slotted bores to provide passage of said bracket side arms when received in said slotted bores.

4. A shelf support structure as claimed in claim 1, wherein said slotted bore associated with said finger is wider than the other bore in the same plate member, said lower support edge is a straight angulated edge extending inwardly downwards under said support end finger to permit entry of said finger in said wider slotted bore and to maintain a top free end portion of said finger behind a top wall portion of said wider slotted bore.

5. A shelf support structure as claimed in claim 4 wherein said slotted bore innermost of said right-angle corner of said vertical side walls of said shelf is wider than the other slotted bore of said pair of slotted bores.

6. A shelf support structure as claimed in claim 1, wherein said support notches are spaced apart a distance sufficient to locate said notches extending outwardly from opposed surfaces of said post.

7. A shelf support structure as claimed in claim 1, wherein there is provided a straight vertical slot in an outer surface of said bridge plate to define a line of weakness to break said plate in two sections by the application of a transverse wedging force against an opposed outer surface.

8. A shelf support structure as claimed in claim 1 wherein each said connecting arms is provided with a pointed lip extending along a top edge of an inner face thereof to grip into said respective side walls of said shelf corner.

9. A shelf support structure as claimed in claim 1 wherein said securing means is constituted by one or more fastener receiving bores in each said connecting arms.

* * * * *